US005372416A

United States Patent [19]

Shapley et al.

[11] Patent Number: 5,372,416

[45] Date of Patent: Dec. 13, 1994

[54] VENDING MACHINE HAVING AN INCORPORATED ANTI VANDAL DOOR

[75] Inventors: Donald A. Shapley, Conway; Max M. Johnston, Russellville, both of Ark.

[73] Assignee: Polyvend, Inc., Conway, Ark.

[21] Appl. No.: 971,314

[22] Filed: Nov. 3, 1992

[51] Int. Cl.[5] ..... A47F 1/00

[52] U.S. Cl. ..... 312/138.1; 312/405; 221/155

[58] Field of Search ..... 312/138.1, 139.1, 114, 312/116, 126, 403, 405; 221/155, 2; 52/780, 822; D20/8, 4

[56] References Cited

U.S. PATENT DOCUMENTS

| | | | |
|---|---|---|---|
| 2,394,176 | 2/1946 | Hillebrand | 312/138.1 X |
| 2,438,972 | 4/1948 | Hoffman | 312/139.1 X |
| 4,817,585 | 4/1989 | Craver | 312/138.1 X |
| 4,823,984 | 4/1989 | Ficken | 221/155 X |
| 4,927,051 | 5/1990 | Falk et al. | 221/155 X |

*Primary Examiner*—Timothy V. Eley
*Assistant Examiner*—Khan V. Nguyen
*Attorney, Agent, or Firm*—Stephen D. Carver; Trent C. Keisling

[57] ABSTRACT

A vandal-proof door and a vending machine equipped with the unique door. The door strengthens and reinforces coin operated vending machines, while providing the customer with a clear, unobstructed view of the product selection inside the machine. The door comprises a rigid, generally rectangular frame having a pair of spaced-apart sides that border a product viewing aperture. An outer, arcuate impact panel having a convex vertical cross section overlies the viewing area. The impact panel is flexibly mounted to the door by elongated, resilient extrusions secured to the frame edges. Similar resilient extrusions receive the top and the bottom of the impact panel. A separate, spaced apart translucent window is internally mounted on the door frame adjacent the viewing area. Gasket sealing material is secured about the panel and window edges to complete a seal. An isolated air pocket is thus defined between the outer impact panel and the inner window. The trapped air acts as a cushion in response to jarring forces or blows, and it resiliently strengthens the door. The door system functions with a variety of vending machine configurations.

24 Claims, 5 Drawing Sheets

VENDING MACHINE HAVING AN INCORPORATED ANTI VANDAL DOOR

BACKGROUND OF THE INVENTION

Our anti-vandal door invention relates generally to vending machines. More particularly, our anti-vandal vending equipment relates to coin operated vending machines classified within numerous subclasses of United States Class 221.

At the present time a wide variety of generally upright, coin-operated vending machines are known in the art. While vending machines can take on a variety of configurations, generally upright enclosures are typically cubical; they have one or more sides or panels, and they contain a variety of products. Typical offerings include food items, candy items, toiletry products, beverages, canned products, cigarettes and the like. A wide variety of product dispensing modules are known, and numerous coin acceptors and actuation circuits have evolved over the years. Products may be discharged from helices, from trays, from rotary wheels, via reciprocating levers or trays, or through a wide variety of varying mechanisms.

In prior Polyvend U.S. Pat. No. 3,512,679, a plurality of multi-section dispensing modules are proposed for use within the generally upright cabinet. U.S. Pat. No. 4,638,922 issued Jan. 27, 1987 discloses a helical vending module of the type seen and known in spiral vending machines of the type which employ elongated helices. Helical vending machine modules are well known and they are described in such patents as U.S. Pat. Nos. 3,178,055, 3,344,953, and 3,653,540 and others.

U.S. Pat. No. 3,752,287 issued Aug. 14, 1973 discloses a generally cubical vending machine of upright dimensions which includes a transparent, front surface access door. A plurality of individual dispensing modules (although not involving helices) are shown. This particular reference discloses how a particular coin mechanism may be electrically wired to effectuate a vend of a given module. The customer merely selects one of a variety of push button combinations corresponding to a particular dispensing module which he can see through the window, inserts the appropriate amount in coinage, and a vend is effectuated through the bottom of the machine to a vend position accessible by a push operated access door. U.S. Pat. No. 3,734,346 discloses a similar vending machine cabinet arrangement in which an anti-theft apparatus is associated with the product access door.

U.S. Pat. No. 3,757,993 discloses a multiple module vending machine having a plurality of individual, chain-driven vending modules dissimilar from helical vending apparatus. "Hook and tab" and/or chain driven dispensing modules are seen in U.S. Pat. Nos. 3,756,455 and 3,716,165.

U.S. Pat. No. 3,294,281, issued to S. Schlaf on Dec. 26, 1966 broadly discloses a generally cubical vending machine in which a plurality of helical dispensing modules are disposed in an orderly fashion to effectuate a preselected customer selected vend. Each of the modules includes an outwardly projecting helice, between the convolutions of which are disposed a number of hole punched products. Motor means are provided whereby after the input of an appropriate value of coins the customer may select his product and a vend will occur. Vending is accomplished by internal rotation of the selected helice one revolution until the most extreme punched product held thereby is dropped through the front of the machine into a customer access area.

Similarly U.S. Pat. Nos. 3,355,064 and 3,572,546 also employ multiple, outwardly extending helices in which a plurality of hole punched products are disposed between adjacent convolutions. Helical vending is also shown in U.S. Pat. No. 3,690,510.

Regardless of the type of vending machine employed in a given situation, one common problem relates to vandalism and theft. Vandalism can occur on a random basis for no apparent reason, or in conjunction with theft. Vending machines are often placed in areas which are not publicly supervised, and are therefore subject to the whim and caprice of vandals. The product inventory inside vending machines must be routinely serviced, so some form of service door is necessary. Prior art doors often provide a pathway for forced entry to determined thieves or vandals. Many of the problems in the art result from the strenuous demands placed upon the machines. Such machines may be located in unwatched areas, subjecting them to frequent attacks of vandalism. It is also recognized in the industry that when coin acceptance mechanisms fail, violent responses on the part of chagrined customers are not uncommon. Such outbursts are often precipitated whether or not the vending apparatus fails. Stated another way, even though slugs or deformed coins have been inserted into the coin mechanism, the failure of the customer to obtain immediate gratification often leads to violent outbursts which are directed upon the vending machine. Destructive acts of violence are also experienced when irate customers select a product that is sold out.

The prior art reflects the vandal factor. U.S. Pat. No. 4,320,933, Issued Mar. 23, 1982 provides a means whereby convenient repairs of a machine are possible in the event of damage. Where panels are defaced or destroyed, they can easily be replaced because the mounting system provided makes them easily removable. Identical panels are used on each side, and the reference teaches the use of durable LEXAN ® panels decorated with suitable product indicia.

Andrews U.S. Pat. No. 3,367,730 shows the use of inner and outer doors for product access. The inclusion of an outer security door in combination with an inner product access door for servicing is one means in the art for vandal proofing of machines and U.S. Pat. No. 3,367,730 is typical.

Klix U.S. Pat. No. 5,108,166, Issued Apr. 28, 1992, discloses a security system for vandal proofing vending machines. Essentially the frame-cage therein disclosed includes an outwardly bowed or arched front panel section disposed between a a pair of arcuate beams. The door section is hingeably coupled to the frame, and apparently force can be distributed by the construction therein disclosed. The reference does lack the teachings of the present invention in that it fails to incorporate itself within the door of a vending machine, it fails to direct force in a similar manner, and it fails to disclose an intermediate sealed air pocket for dissipating force.

Although not intended to be vandal-proof, Brandes U.S. Pat. No. 4,682,709 shows a vending machine having a frame and a plurality of removable panels. The panels are curved and arcuately disposed so as to suggest the appearance of a can or container. U.S. Pat. No. 5,090,589 issued Feb. 25, 1992, discloses a vending machine including a front, bowed sign panel. Although the curved sign panel is oriented convexly, impact resistance is not discussed.

Numerous design patents exist which show some form of arched or convex front face in a vending machine. Known design patents of this type have the following numbers D-314,796; D-297,742; D-295,294; D-294,958; D-294,719; D-294,718; D-294,717; D-294,716; D-290,619; D-290-272; D-290,271; D-290,270; D-290,269; D-145,609; and D-110,511.

One problem with known vandal resistant designs is that heavy glass panels tend to obscure the contents of the vending machine. Whereas in certain types of vending machines the contents are known and need not be observed by the customer, as in the case of certain beverage dispensers, the common helical vending machine dispenses a wide variety of products. The user must have an unobstructed view of the cabinet interior in order to make a selection. In the past, the more protective "armor" put between the observer/customer and the machine interior to protect the same from vandalism, the less likely it has been that the consumer could clearly see the intended purchase. Hence it is important to provide a system which vandal-proofs the machine without obscuring the view of the consumer.

Stated another way, any type of vandal resistant door system used for product vending machines of the type herein contemplated must not occlude the view of the customer. An unobstructed view afforded by a reinforcing door is thus a fundamental principle of our invention.

SUMMARY OF THE INVENTION

We have designed a vandal-proof vending machine, and in particular, a vandal-proof door for vending machines. Our door appreciably strengthens and reinforces typical coin operated vending machines, without obstructing customer view of the products inventoried within the machine. It may be employed with a variety of vending machine configurations, whether refrigerated or not, involving punched product/helice vendors, gum and mint machines, beverage machines, canned product dispensers, rotary drum vendors, and the like.

In the best mode the vandal-proof door comprises a rigid, generally rectangular frame having a top and a bottom extending between a pair of parallel sides that circumscribe a central, product viewing aperture. A shock-resistant outer panel arches away from the door frame. This transparent, impact panel is placed over the door viewing area, and product may be viewed through it. The panel extends between the top and bottom of the vending machine, and it has a convex vertical cross section. Preferably it comprises a sheet of LEXAN® material. The impact panel is preferably mounted to the door at opposite panel sides by elongated, resilient extrusions secured to the frame edges. Similar resilient extrusions receive the top and the bottom of the impact panel.

In the best mode a separate, spaced apart transparent window is mounted on the door frame against the viewing area. It is spaced apart from the impact panel, and it covers the product viewing orifice in the door frame. It is biased against the rear periphery of the door frame by mounting braces, and gasket material is employed about the window edges to complete a seal. Thus an isolated air pocket is formed between the outer impact panel and the inner window. The trapped air acts as a cushion in response to jarring forces or blows, and it resiliently strengthens the door. Furthermore, the air pocket helps the impact panel return to its original shape after a blow.

The resilient extruded, mounting system is preferably comprised of resilient material. Extrusions extend generally from the top to the bottom of the cabinet door on each side, and across the top and bottom. In the best mode the side extrusions are generally cubical in cross section, comprising a base equipped with a transverse slot in which fasteners are partially captivated, and an angularly inclined slot that receives impact panel edges. Relief grooves formed in the extrusion cooperate with integral walls to resiliently deform to absorb impacting forces. As the panel is compressed forces are distributed about the periphery of the apparatus by the extrusions, and force is non-destructively dissipated.

Thus, a fundamental object of our invention is to provide a see-through service door for a vending machine that substantially vandal-proofs the machine.

More particularly, an object of our invention is to provide a see-though, vandal-resistant door for vending machines and a vending machine equipped with such a door.

Another object of the present invention is to provide a force distribution system for a vending machine door, wherein a flexible impact panel mounted to the door distributes force in such a way as to prevent breakage.

Yet another object of the present invention is to provide a door for a vending machine through which the customer may easily see the inventory of products to be vended.

A similar object is to provide a service access door for a vending machine that may be used upon a wide variety of conventional vending machines.

A similar object of the present invention is to provide a vending machine door of the character described which vandal proofs the system and prevents the glass doors or panels from being broken.

Another object of the present invention is to minimize the chances of injury to irate customers and vandals.

Another object of the present invention is to provide a vandal-proof door system of the character described which will not obstruct the view of the customer into the interior of the vending machine.

Another important object is to provide a vandal-resistant door for vending machines that may be easily serviced. It is a feature of our invention that the window may be removed from the door without removing the panel, and vice versa.

A still further object of the present invention is to provide a vending machine with a door of the character described.

Yet another object of the present invention is to provide a door system for a vending machine that is flexible, highly resilient, and damage resistant.

Yet another object of the present invention is to provide a sealed air chamber within a door to reinforce it and distribute forces about the door periphery.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
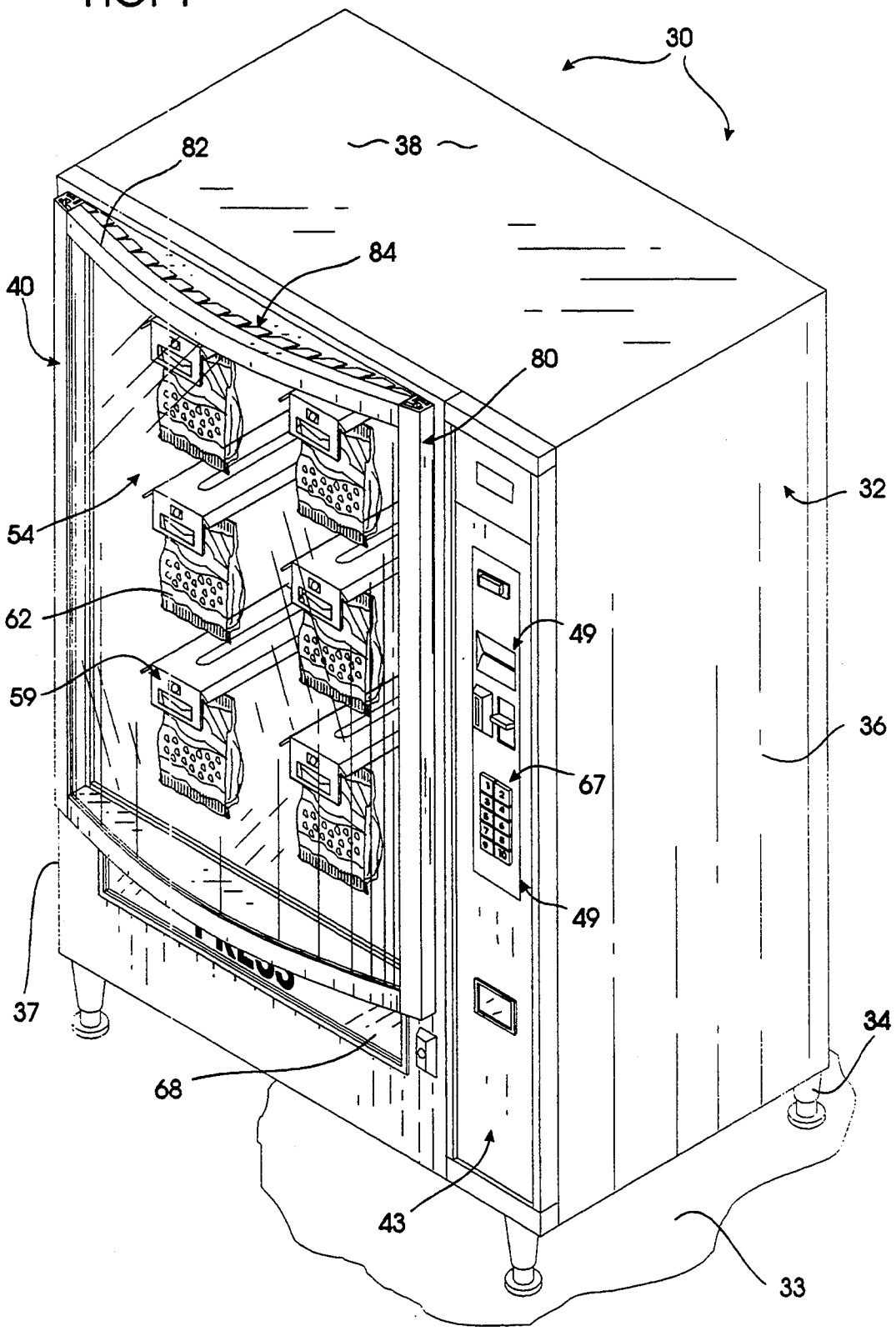
FIG. 1 is a partially fragmentary perspective view of a vending machine equipped with our vandal-proof door.
Figure 2:
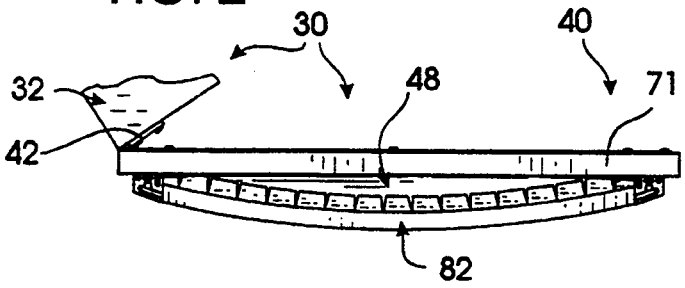
FIG. 2 is a fragmentary top plan view of the door.
Figure 3:
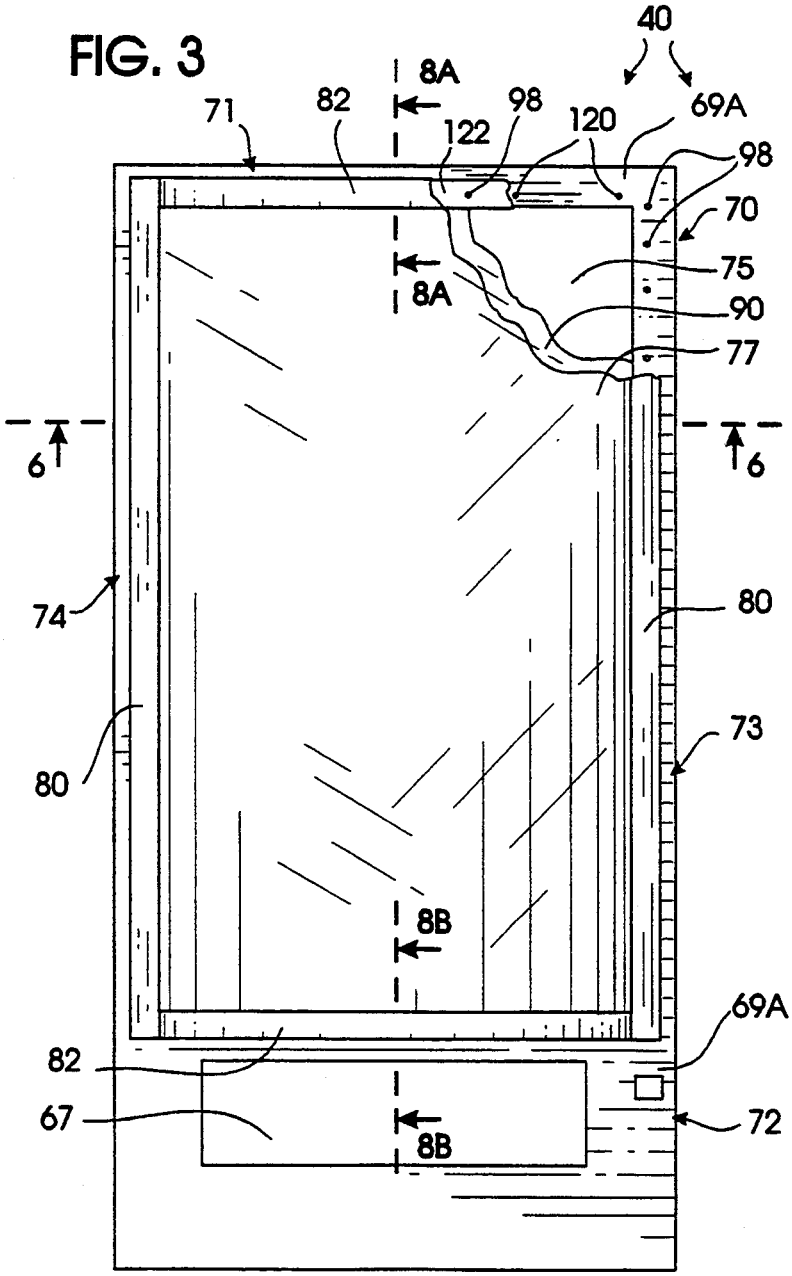
FIG. 3 is front elevational view of the preferred door.
Figure 4:
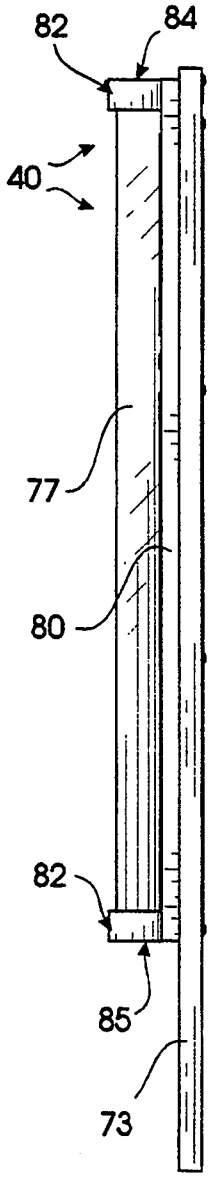
FIG. 4 is a side elevational view of the door, taken from a position generally to the right of FIG. 3.

With initial reference now directed to FIGS. 1 and 2 of the appended drawings, a vandal-proof vending machine constructed in accordance with the teachings of the present invention has been generally designated by the reference numeral 30. In the best mode, machine 30 comprises a generally cubical, upright cabinet 32 disposed upon a lower, supporting surface 33 by a plurality of conventional feet 34. Cabinet 32 preferably comprises a pair of spaced apart sides 36, 37, and a top 38. The vandal-proof door has been generally designated by the reference numeral 40. As seen in FIG. 2, it is coupled to the cabinet by a conventional hinge 42 so it may be pivoted away from the cabinet during service to expose the cabinet interior. When in normal use, door 40 reinforces the machine 30 against vandalism, while providing customers with a completely clear, unobstructed view of products 62 to be vended that are disposed within the interior.

A front side panel 43 of the cabinet includes conventional coin acceptance and selection apparatus 49 and a coin return 51. It will be noted that the interior of the cabinet, generally designated by the reference numeral 54, houses a variety of packaged products 62. In the illustrated embodiment a plurality of conventional helical vending modules 59 are employed. As explained in numerous prior patents, modules 59 include an outwardly projecting helice, upon which punched products 62 are captivated. A vend occurs when the proper module 59 is selected by the push button selectors 67, after a customer first decides his selection by viewing the cabinet interior 54 through the door. When a product is vended, it drops down within the cabinet interior 54 to a lower product dispensing port, which may be reached by the customer by deflecting a conventional dispensing door 68 hingeably coupled to the door assembly 40. It will be appreciated that a variety of other product dispensing modules or devices may substituted for the helical modules 59 illustrated within cabinet 32. Thus our vandal-proof door system 40 is not limited to vending machines employing helical vending.

Figure 5:
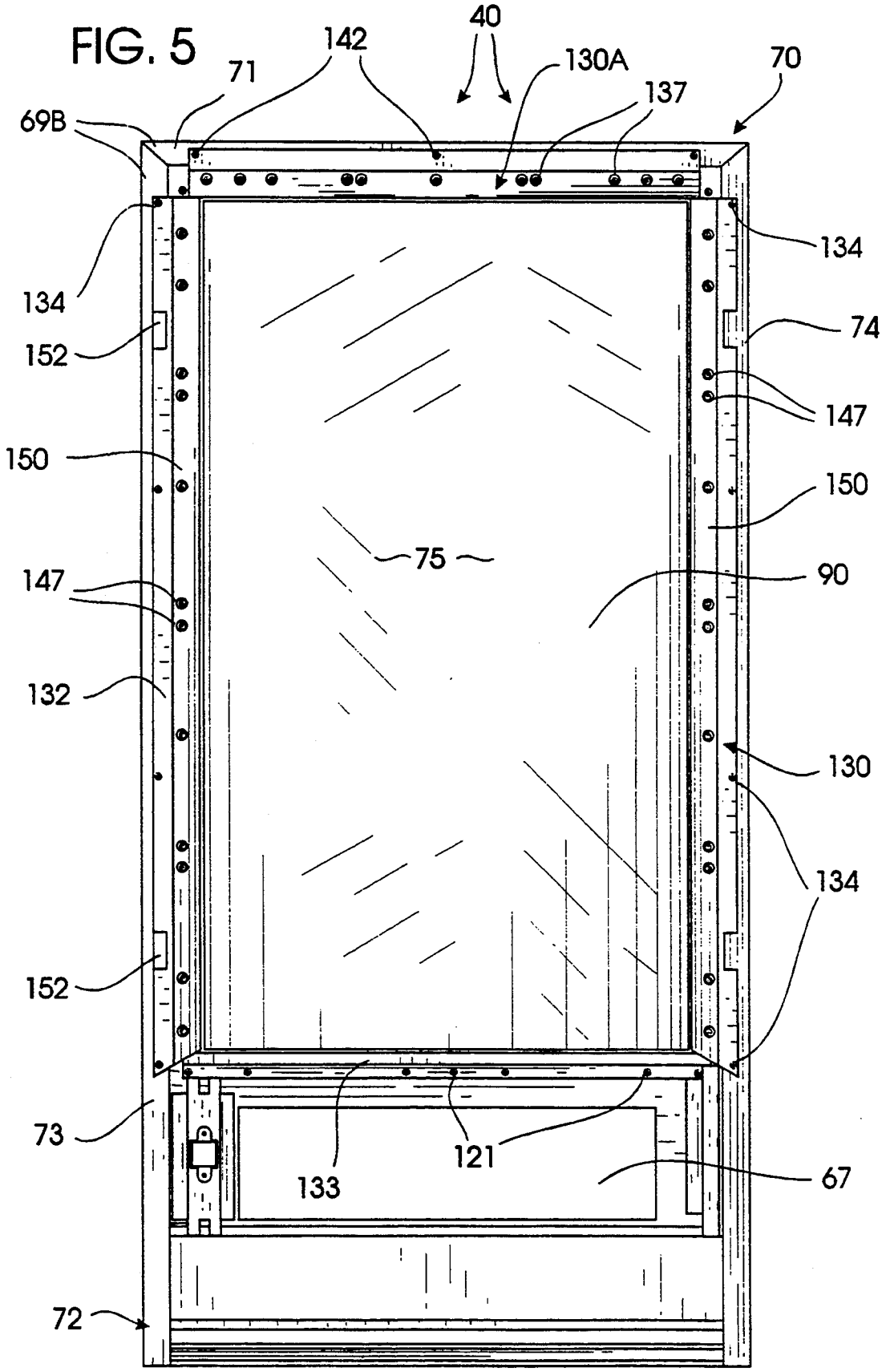
FIG. 5 is a rear elevational view of the preferred door.

With reference now primarily directed to FIGS. 3–7, door 40 comprises a rigid frame generally designated by the reference numeral 70 that comprises a rigid top 71, a rigid bottom generally designated by the reference numeral 72, and a pair of rigid sides 73 and 74 that extend between top 71 and bottom 72. A product access door 68 mounts over a suitable generally rectangular orifice 67 (FIG. 3) defined in the bottom 72 of door 40. The front outer surface periphery of the door has been generally designated by the reference numeral 69A; the rear, inner periphery of the door has been generally designated by the reference numeral 69B (FIG. 5). A central viewing orifice 75 of generally rectangular dimensions is defined between the sides, the top and the bottom of door 40. When the door is operationally mounted to the cabinet 32 it does not visually block the interior 54 of the vending machine 30.

Importantly, a preferably arcuate and transparent impact-resistant panel 77 is preferably disposed over the door viewing area 75. This panel 77 extends between the top and bottom of the vending machine, and is outwardly "bowed" or arched as best viewed in FIGS. 1, 2 and 6. Panel 77 is oriented such that its vertical cross section (i.e. FIG. 6) is convex, and the panel arches or projects away from the peripheral surface 69A of the door (more particularly the viewing orifice 75).

Figure 6:
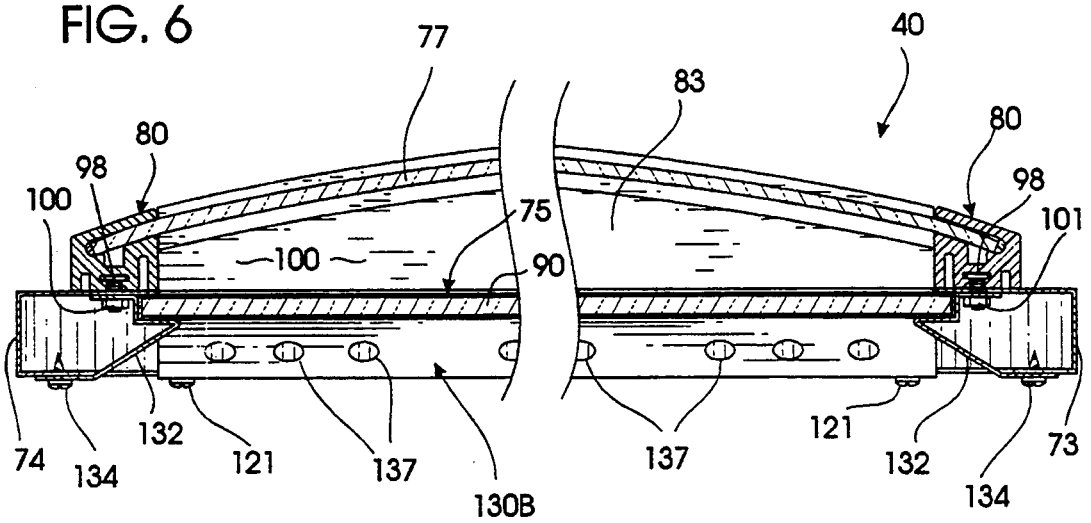
FIG. 6 is a fragmentary sectional view taken generally along line 6—6 of FIG. 3.
Figure 8A:
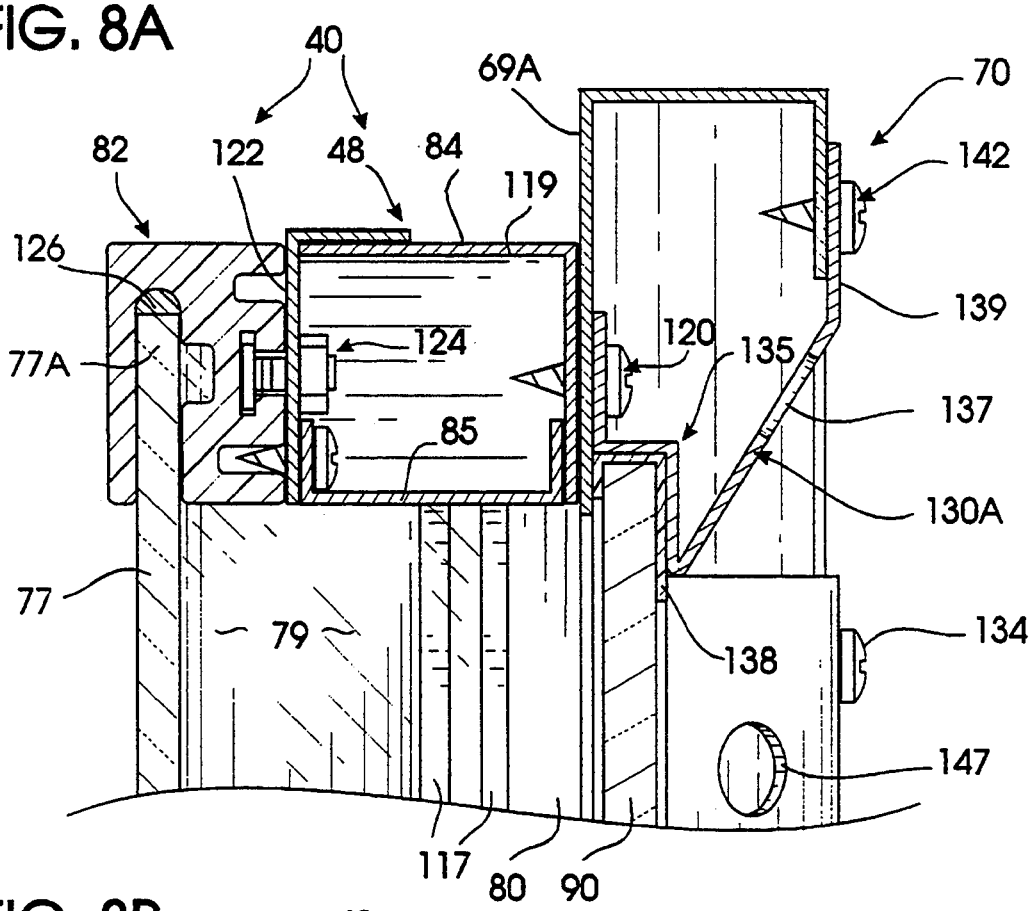
FIG. 8A is an enlarged, fragmentary sectional view taken generally along line 8A—8A of FIG. 3; and, FIG. 8B is an enlarged, fragmentary sectional view taken generally along line 8B—8B of FIG. 3.
Figure 8B:
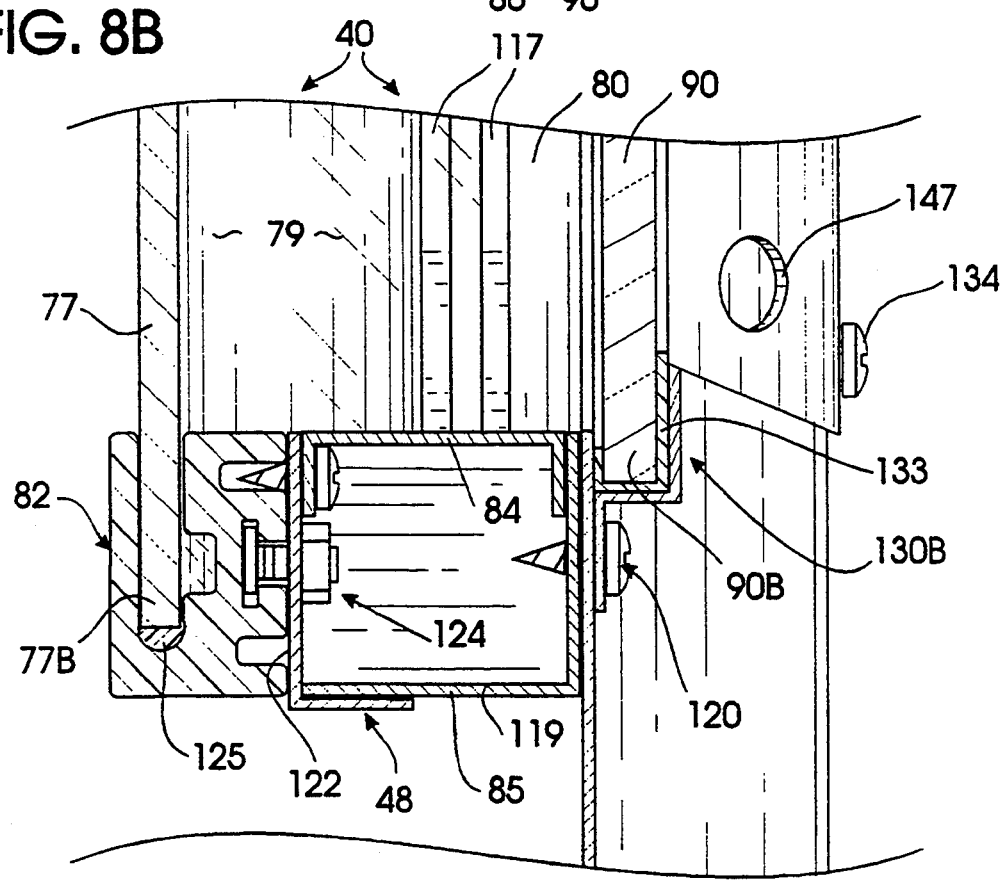

Panel 77 is mounted to the door 40 at opposite panel sides 72, 73 by elongated, preferably extruded mounting extrusions 80. The resilient extrusions 80 are mounted on the opposite outer peripheral surfaces formed by the sides 73, 74 of the door. Similar resilient extrusions 82 are employed to mount the top 77A and the bottom 77B of the panel 77 to the door 40 (FIGS. 8A, 8B). The inner curved surface of impact panel 77 has been designated by the reference numeral 79 in FIGS. 8A and 8B. Extrusions 82 (FIG. 6) are arched by two piece metallic standoffs 48 comprising inner and outer portions 84 and 85 fitted together as shown. The standoffs 48 overlays the top 71 and bottom 72 of the door. As seen in FIG. 6, the cavity formed within standoffs 48 is esthetically shrouded with a decorative cover plate 83.

Figure 7:
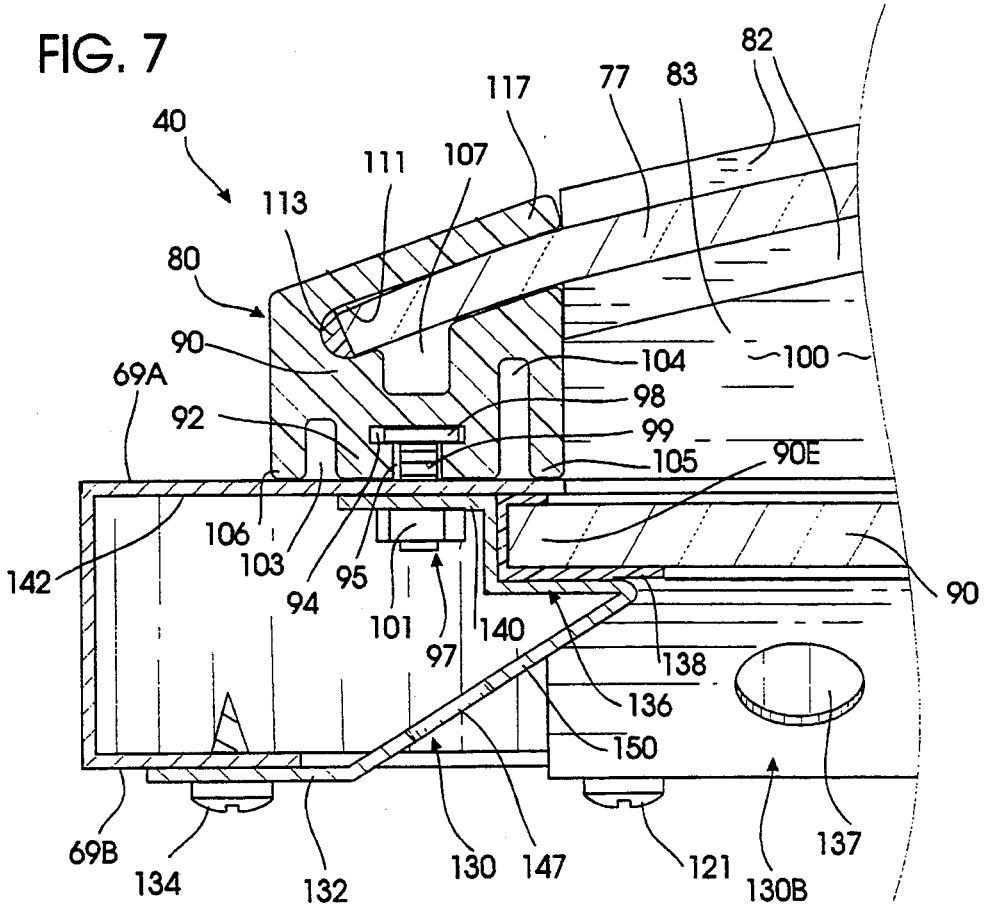
FIG. 7 is an enlarged, fragmentary cross sectional view showing typical panel mounting components taken generally from the left side of FIG. 6.

Importantly, a flat, substantially transparent window generally designated by the reference numeral 90 (FIGS. 6–7, (8A, 8B) is biased against the rear periphery of the door frame to complete a seal. Thus an isolated air volume 100 is formed between the panel 77 and window 90 for resiliently strengthening the door.

With primary reference now directed to FIG. 7, the resilient mounting system comprises an elongated extrusion 80 preferably formed of resilient plastic or the like. It extends generally from the top to the bottom of the door on each side 73, 74 thereof, resting upon the front outer periphery 69A of the door. In the best mode the resilient extrusion is generally cubical or block-like in cross section, as best seen in FIGS. 6 and 7. In cross section the extrusion 80 forms a base 91 having a central section 92 equipped with a transverse slot 94 oriented generally perpendicularly to a slot access opening 95. A fastener 97 preferably comprising a nut and bolt combination has a head 98 captivated within slot 94. The fastener shank 99 extends through the frame surface 69A and is terminated by a nut 101. A plurality of such fasteners disposed along the length of the frame sides are employed within the slot 94 of the extrusion 80 for convenient assembly. Access to nut 101 is facilitated through orifices 147 (FIG. 5).

Relief grooves 103, 104 are formed on opposite sides of the slot 94 adjacent, integral walls 105 and 106. The flexible walls border the relief grooves. A central internal relief groove 107 is defined above slot 94, and it communicates with an elongated, angularly inclined slot 111 adapted to receive the edge of the panel 77. Panel edges are received within slot 111, and the terminal panel edges forcibly abut resilient sealer gasket 113 which prevents the escape of air around the edges. As the panel 77 is compressed forces are distributed about the periphery of the apparatus because of the design of the extrusion. The various slots and walls enable non-destructive flexing, and force is dissipated. The uppermost lip portion 117 of the segmented extrusion is visible in FIGS. 8A and 8B.

Turning now to FIGS. 8A and 8B, the extrusions 82, disposed alternately on the top and bottom of the apparatus are offset and themselves bowed by the metallic standoffs 48 previously discussed. The standoff portions 84, 85 are somewhat half moon shaped, having a profile of a slice of a circle, so as to seal the top and bottom confines of the internal volume 100. The outwardly projecting portion 119 (FIG. 8A) extends away from the outer peripheral surface 69A of the frame 70, and receives a cooperating, segmented member 122 to which the extrusion 82 is attached with fasteners 124 similar to fastener 97 previously discussed. Thus the upper edge 77A and the bottom edge 77B of the panel 77 are captivated within extrusions 82, and sealed by appropriate plastic gasket material 125, 126 (FIGS. 8A, 8B).

As best viewed in FIGS. 7, 8A and 8B, the window 90 is also terminated near the panel on the opposite inner surface of the frame, maintained by a fastener 120 (i.e., a sheet metal screw). The window is secured in place by an elongated, metallic brace generally designated by the reference numeral 130. Brace 130 comprises a flange portion 132 secured by a suitable fastener 134 to the inner peripheral surface 69B (FIG. 7) of the door frame 70. A squared, notch portion, generally designated by the reference numeral 136 abuts the end portion 90E of the window (FIG. 7), compressing against it a captivated resilient sealer 138 which prevents air loss. The notch terminates in a leg portion 140 which is fastened against the underside 142 of the frame by the fastener 97 previously discussed. A plurality of orifices 147 disposed along the length of the brace 130 permit inspection or access to fasteners 97 during assembly. Similar braces 130A are employed on the top of the window to secure it on the top of the frame (FIGS. 8A, 8B). Orifices 137 are disposed along the length of brace 130A to permit inspection of fasteners 120.

The bottom brace 130B (FIG. 8B) is somewhat simpler, having a generally "Z" shaped profile and urging gasket material 133 against the bottom 90B of the window. A similar piece of gasket material 138 is jammed into the corner notch 135 formed by brace 130A at the top of the apparatus. Brace 130A includes a leg 139 fastened with a conventional fastener 142 to the frame 70. Braces 130A, 130B and 130 on the sides extend all the way between the top and bottom of the apparatus, as best seen in FIG. 5. The brace includes a transverse portion 150 extending to the notch and from the flange 132 which is oriented generally parallel with portion 117 of the extrusion 80 disposed above the mounting slot 111 (FIG. 7). Clearance slots 152 are periodically along the length of the flange 132. The braces may be removed to service or replace the window without removing the impact panel, and the impact panel may be removed without disconnecting the braces.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described our invention we claim:

1. A vandal-proof vending machine comprising:

an upright cabinet adapted to be disposed upon a supporting surface, said cabinet comprising an interior filled with products to be vended;

a product dispensing port adjacent said interior;

a dispensing door mounted to said cabinet for permitting customer access to said dispensing port after a vend;

a vandal-proof, see through door hinged to said cabinet for selectively permitting service access to said cabinet interior while normally facilitating an unobstructed customer view of said interior, said door comprising:

a rigid, generally rectangular frame defining a central viewing orifice, a pair of spaced apart sides and a top and a bottom;

an arcuate, substantially transparent, impact-resistant panel secured to said frame over said viewing orifice;

resilient mounting means for securing said panel to said frame, said resilient mounting means comprising an elongated extrusion disposed on each side of said frame for flexibly receiving edges of said panel;

a flat, substantially transparent window disposed between said impact resistant panel and said cabinet interior;

an air pocket defined between said panel and said window for resisting deformation of said door in response to vandalism and acts of forcible impact;

fastener means projecting from said frame to mount said extrusion; and, said extrusion comprising a central, slotted base adapted to captivate at least a portion of said fastener means and relief means defined in said base for distributing impact.

2. The vending machine as defined in claim 1 wherein said extrusion comprises an angularly inclined slot adapted to receive an edge of said panel.

3. The vending machine as defined in claim 2 including a resilient mounting brace coupled to said frame at a rear inner periphery thereof for enabling said window to be removed without removing said panel, said brace comprising a notch contacting edges of said window, a flange adapted to be secured to said frame, and a spring portion extending diagonally between said flange and said notch for biasing said window.

4. The vending machine as defined in claim 3 wherein said brace spring is generally parallel with said angularly inclined slot in said extrusion.

5. The vending machine as defined in claim 3 including sealant means disposed in said notch for sealing said window.

6. The vending machine as defined in claim 3 wherein:

said fastener means comprises a plurality of spaced apart screws having heads captivated in said slotted base and shanks penetrating said frame and brace leg;

said brace leg is secured to said frame by nuts coupled to said screws; and, wherein said brace spring portion comprises a plurality of spaced apart apertures permitting access to said nuts.

7. A vandal-proof, see through door adapted to be hinged to a vending machine for selectively permitting service access to the cabinet interior while normally facilitating an unobstructed customer view of said interior, said door comprising:

a rigid, generally rectangular frame defining a central viewing orifice, a pair of spaced apart sides and a top and a bottom;

an arcuate, substantially transparent, impact-resistant panel secured to said frame over said viewing orifice;

resilient mounting means for securing said panel to said frame, said resilient mounting means comprising an elongated extrusion disposed on each side of said frame for flexibly receiving edges of said panel;

a flat, substantially transparent window disposed between said impact resistant panel and said cabinet interior; and, an air pocket defined between said panel and said window for resisting deformation of said door in response to vandalism and acts of forcible impact;

fastener means projecting from said frame to mount said extrusion; and, said extrusion comprising a central, slotted base adapted to captivate at least a portion of said fastener means and relief means defined in said base for distributing impact.

8. The door for a vending machine as defined in claim 7 wherein said extrusion comprises an angularly inclined slot adapted to receive an edge of said panel.

9. The door for a vending machine as defined in claim 8 including a resilient mounting brace coupled to said frame at a rear inner periphery thereof for enabling window to be removed without removing said panel, said brace comprising a notch contacting edges of said window, a flange adapted to be secured to said frame, and a spring portion extending diagonally between said flange and said notch for biasing said window.

10. The door for a vending machine as defined in claim 9 wherein said brace spring is generally parallel with said angularly inclined slot in said extrusion.

11. The door for a vending machine as defined in claim 9 including sealant means disposed in said notch for sealing said window.

12. The door for a vending machine as defined in claim 9 wherein:

said fastener means comprises a plurality of spaced apart screws having heads captivated in said slotted base and shanks penetrating said frame and brace leg;

said brace leg is secured to said frame by nuts coupled to said screws; and, wherein said brace spring portion comprises a plurality of spaced apart apertures permitting access to said nuts.

13. A vandal-proof vending machine comprising:

an upright cabinet comprising an interior containing products to be vended;

a vandal-proof, see through service door coupled to said cabinet for selectively permitting service access to said interior and for enabling customers to readily view products within said interior, said door comprising:

a rigid frame comprising a pair of spaced apart sides and a top and a bottom, defining a viewing orifice, said frame mounted to said cabinet;

a substantially transparent, impact-resistant panel secured to said frame over said viewing orifice;

resilient mounting means comprising an elongated extrusion disposed on each side of said frame for flexibly receiving edges of said panel and securing said panel to said frame;

fastener means projecting from said frame to mount said extrusion;

said extrusion comprising a central, slotted base adapted to captivate at least a portion of said fastener means and an angularly inclined slot adapted to receive an edge of said panel;

a substantially transparent window disposed between said impact-resistant panel and said cabinet interior; and, an air pocket is defined between said panel and said window for resisting deformation of said door in response to vandalism and acts of forcible impact.

14. The vending machine as defined in claim 13 wherein said extrusion comprises relief means defined in said base for distributing impact forces.

15. A vandal-proof see through service door for vending machines having an upright cabinet comprising an interior containing products to be vended, said door comprising:

a rigid frame comprising a pair of spaced apart sides and a top and a bottom, and defining a viewing orifice;

a substantially transparent, impact-resistant panel secured to said frame over said viewing orifice;

resilient mounting means comprising an elongated extrusion disposed on each side of said frame for flexibly receiving edges of said panel for securing said panel to said frame;

said extrusion comprising a central, slotted base adapted to captivate at least a portion of said fastener means and an angularly inclined slot adapted to receive an edge of said panel;

fastener means projecting from said frame to mount said extrusion;

a substantially transparent window secured to said door and disposed between said impact-resistant panel and said cabinet interior; and, an air pocket is defined between said panel and said window for resisting deformation of said door in response to vandalism and acts of forcible impact.

16. The door for a vending machine as defined in claim 15 wherein said extrusion comprises relief means defined in said base for distributing impact forces.

17. A vandal-proof vending machine comprising:

an upright cabinet having an interior for storing products to be vended;

a vandal-proof, see through service door coupled to said cabinet for selectively permitting service access to said interior while enabling customers to readily view said products, said door comprising:

a central viewing orifice;

a rigid, generally rectangular frame comprising a pair of spaced apart sides and a top and a bottom peripherally surrounding said viewing orifice;

a substantially transparent, arcuate impact panel secured to said door over said viewing orifice; and, resilient mounting means for securing said impact panel to said door comprising an elongated extrusion disposed on each side of said frame for flexibly receiving opposite side edges of said impact panel;

wherein a sealed air pocket is defined between said panel and said interior for resisting deformation of said door in response to vandalism and acts of forcible impact;

said door comprising a flat, substantially transparent window disposed between said impact resistant panel and said cabinet interior, and fastener means projecting from said frame to mount said extrusions, and wherein said extrusions comprise a central, slotted base adapted to captivate at least a portion of said fastener means.

18. For a vending machine comprising an upright cabinet having an interior for storing products to be vended, a vandal-proof, see through service door adapted to be coupled to said cabinet for selectively permitting service access to said interior while enabling customers to readily view said products, said door comprising:

a central viewing orifice;

a rigid, generally rectangular frame comprising a pair of spaced apart sides and a top and a bottom peripherally surrounding said viewing orifice;

a substantially transparent, arcuate impact panel secured to said door over said viewing orifice; and, resilient mounting means for securing said impact panel to said door comprising an elongated extrusion disposed on each side of said frame for flexibly receiving opposite side edges of said impact panel;

wherein a sealed air pocket is defined between said panel and said interior for resisting deformation of said door in response to vandalism and acts of forcible impact;

said door comprising a flat, substantially transparent window disposed between said impact resistant panel and said cabinet interior; and, fastener means projecting from said frame to mount said extrusions, and wherein said extrusions comprise a central, slotted base adapted to captivate at least a portion of said fastener means.

19. A vandal-proof vending machine comprising:

an upright cabinet comprising an interior containing products to be vended;

a vandal-proof, see through service door coupled to said cabinet for selectively permitting service access to said interior and for enabling customers to readily view products within said interior, said door comprising:

a rigid frame comprising a pair of spaced apart sides and a top and a bottom and defining a viewing orifice, said frame mounted to said cabinet;

a substantially transparent, impact-resistant panel secured to said frame over said viewing orifice;

resilient mounting means comprising an elongated extrusion disposed on each side of said frame for flexibly receiving edges of said panel to secure said panel to said frame;

a substantially transparent window disposed between said impact-resistant panel and said cabinet interior; and, an air pocket is defined between said impact resistant panel and said window for resisting deformation of said door in response to vandalism and acts of forcible impact; and, fastener means projecting from said frame to mount said extrusion, and wherein said extrusion comprises a central, slotted base adapted to captivate at least a portion of said fastener means.

20. The vending machine as defined in claim 19 wherein said extrusion comprises an angularly inclined slot adapted to receive an edge of said panel.

21. The vending machine as defined in claim 20 wherein said extrusion comprises relief means defined in said base for distributing impact forces.

22. A vandal-proof see through service door for vending machines having an upright cabinet comprising an interior containing products to be vended, said door comprising:

a rigid frame comprising a pair of spaced apart sides and a top and a bottom, and defining a viewing orifice;

a substantially transparent, impact-resistant panel secured to said frame over said viewing orifice;

resilient mounting means for securing said panel to said frame comprising an elongated extrusion disposed on each side of said frame for flexibly receiving edges of said panel; and, a substantially transparent window secured to said door and disposed between said impact-resistant panel and said cabinet interior;

an air pocket defined between said impact resistant panel and said window for resisting deformation of said door in response to vandalism and acts of forcible impact; and, fastener means projecting from said frame to mount said extrusion, and wherein said extrusion comprises a central, slotted base adapted to captivate at least a portion of said fastener means.

23. The door for a vending machine as defined in claim 22 wherein said extrusion comprises an angularly inclined slot adapted to receive an edge of said panel.

24. The door for a vending machine as defined in claim 23 wherein said extrusion comprises relief means defined in said base for distributing impact forces.

* * * * *